United States Patent [19]

Pinson

[11] Patent Number: 4,765,222

[45] Date of Patent: Aug. 23, 1988

[54] ELECTROSTATIC KINETIC ENERGY WEAPON

[75] Inventor: George T. Pinson, Huntsville, Ala.

[73] Assignee: The Boeing Company, Seattle, Wash.

[21] Appl. No.: 793,613

[22] Filed: Oct. 28, 1985

[51] Int. Cl.[4] ..... F41F 1/02

[52] U.S. Cl. ..... 89/8; 124/3; 313/360.1; 313/361.1

[58] Field of Search ..... 89/8; 124/3; 310/12–14; 318/135; 376/100, 102, 108, 125, 128; 313/359.1, 360.1, 361.1; 315/111.41, 111.51, 111.61

[56] References Cited

U.S. PATENT DOCUMENTS

| | | | |
|---|---|---|---|
| 1,384,769 | 7/1921 | Maclaren | 310/13 X |
| 2,870,675 | 1/1959 | Salisbury | 89/8 X |
| 3,361,980 | 1/1968 | Kane | 313/249 X |
| 3,761,828 | 9/1973 | Pollard et al. | 313/359.1 X |
| 4,076,993 | 2/1978 | Nowak | 313/360.1 |
| 4,109,883 | 8/1978 | Korr et al. | 89/8 X |
| 4,283,631 | 8/1981 | Turner | 376/108 |
| 4,319,168 | 3/1982 | Kemeny | 89/8 X |
| 4,343,223 | 8/1982 | Hawke et al. | 124/3 X |
| 4,429,612 | 2/1984 | Tidman et al. | 124/3 X |
| 4,432,333 | 2/1984 | Kurherr | 89/8 X |

*Primary Examiner*—Stephen C. Bentley

*Attorney, Agent, or Firm*—Finnegan, Henderson, Farabow, Garrett & Dunner

[57] ABSTRACT

An electrostatic kinetic energy weapon for firing projectiles at speeds up to and in excess of 100 kilometers per second. The weapon having a projectile launcher for launching projectiles using interactive forces acting between charged elements.

11 Claims, 2 Drawing Sheets

ELECTROSTATIC KINETIC ENERGY WEAPON

BACKGROUND OF THE INVENTION

This invention relates to an energy weapon and more particularly but not by way of limitation, to the launching of a projectile weapon using electrostatic kinetic energy.

Heretofore, the only known method that can accelerate projectiles at speeds above 2 km/sec was based on electromagnetic propulsion. These designs utilize an electromagnetic field to accelerate a projectile to a high speed. This type of design, however, is limited to speeds of up to several 10's of kilometers per second. Also, this type of design requires large power supplies in the kilojoule and megajoule range because of the power loss caused by ohmic heating in the electromagnets. Further, this design requires complex electrical power switches that can operate rapidly and handle the large currents necessary to create and control the magnetic field.

Other related designs, when compared to the subject invention are found in the design of cathode ray tubes and similar devices. In these designs, the projectile used is an electron which has a mass so small that it reacts almost instantly to a field. The subject invention has a large mass in size and both mass and time become important considerations.

In the following U.S. Patents: U.S. Pat. No. 2,870,675 to Salisbury; U.S. Pat. No. 3,361,980 to Kane; U.S. Pat. No. 4,109,883 to Korr et al; U.S. Pat. No. 4,319,168 to Kemeny; U.S. Pat. No. 4,343,223 to Hawke et al; U.S. Pat. No. 4,429,612 to Tidman et al and U.S Pat. No. 4,432,333 to Kurherr various types of electromagnetic accelerators, anti-missile missiles and related liner accelerators are disclosed. None of these prior art patents particularly point out the unique features and advantages of the subject energy weapon.

SUMMARY OF THE INVENTION

The subject electrostatic kinetic energy weapon overcomes the limitations of prior art electromagnetic weapon systems. The only limitation in the projectile speed of the energy weapon is available power and the relativistic effect of the speed of the projectile as it begins to approach a significant fraction of the speed of light.

When using a projectile mass of approximately 1 gram, the power usage of the weapon is efficient and losses are primarily caused by the power required to accelerate the projectile. There is no major ohmic heating losses. Further, the subject invention does not require power switching.

The subject invention includes a power supply connected to the accelerator plates through capacitors. A negatively or positively charged projectile with an opposite charge on the accelerator plates is placed in the vicinity of a first plate. The plate attracts the projectile. The projectile follows a field through and between a plurality of negative plates and positive plates. As the projectile passes through the plates energy is taken from the system through the capacitors. An alternate approach to the sequence of positive and negative plates is the synchronized switching of polarities with the projectile trajectory positions. At each stage as the projectile passes through the plates the velocity of the projectile is increased. For a specific application it may be required to insert a grounded plate between each of the (+) and (−) charged plates for proper field isolation. The weapon may also include "X" and "Y" deflection plates for providing a deflection angle to the launched projectile.

The advantages and objects of the invention will become evident from the following detailed description of the drawings when read in connection with the accompanying drawings which illustrate preferred embodiments of the invention.

DETAILED DESCRIPTION OF THE DRAWINGS

The electrostatic kinetic energy weapon is based on the interactive forces between charged elements. These interactive forces have been described in classical physics. The basic law is defined by the following equation:

$$F=K(Q_1Q_2/R^2)$$

In this relationship, K is a proportionally constant, $Q_1$ and $Q_2$ are the charges on two separate bodies and R is the distance between the two bodies. This equation can also be written as F=EQ where E is the potential through which the charge Q falls.

Figure 1:
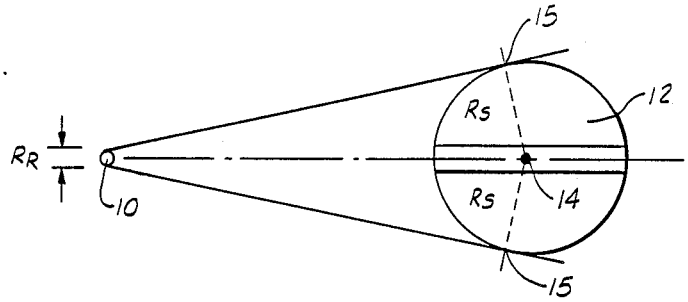
FIG. 1 illustrates the theory behind the use of the spherical projectile.

The following description provides background information that provides some understanding and theory behind the subject invention. For example, assume that a small spherical projectile 10 with some initial velocity Vo approaches a large charged sphere 12 shown in FIG. 1. The large sphere 12 has a hole 14 in it which is small and is comparable to the diameter of the projectile 10. The charge of each of the two spheres in a vacuum is given by the following equation:

$$Q_{1,2}=0.11R_{1,2}^2$$

where R is the radius of the spheres 10 and 12.

As far as the projectile 10 is concerned, it is attracted to the large sphere 12 by that portion of the charge on the sphere 12 inside an area tangential to a cone with an apex at the hole 14 and base barely touching the large sphere 12. When the initial velocity of the projectile 10 is zero, the velocity of the projectile at a point 15 of intersecting the large sphere 12 is given by the following equation:

$$v=(2QE/M)^{\frac{1}{2}}$$

For a 1 gram solid uranium projectile, the speed obtained by a potential (E) of 100,000 volts is 11.4 meters per second.

The above equation can be written:

$$v=(6QE/4\pi R^3SG)^{\frac{1}{2}}$$

Figure 3:
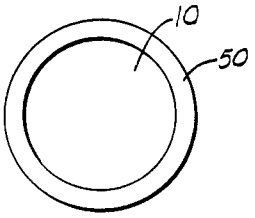
FIGS. 3, 3A and FIG. 4 illustrate the projectile and alternate projectile.
Figure 4:
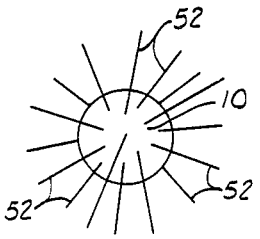

For a given mass, the parameter $R^3SG$=constant. Because of the dependency of Q on R, the velocity can be significantly increased if the radius can be maximized. This is possible by recognizing the specific gravity (SG) of the projectile 10 is the effective specific gravity of the total volume of the projectile 10 and not the specific gravity of the material of which the projectile 10 is made. The preceding discussion presents a significant part of this invention. This recognition permits the hollow projectile 10 as shown in FIG. 3 and FIG. 4 to be designed with the only requirement being the mass of the projectile to be 1 gram or some other desired value. To illustrate the importance of this, the charge on 1 gram of an uranium projectile is 6.48E-07COU where the charge on a 1 cm radius hollow sphere is 1.1E-05COU. This is a factor of 100 improvement in the charge on the projectile 10.

Figure 2:
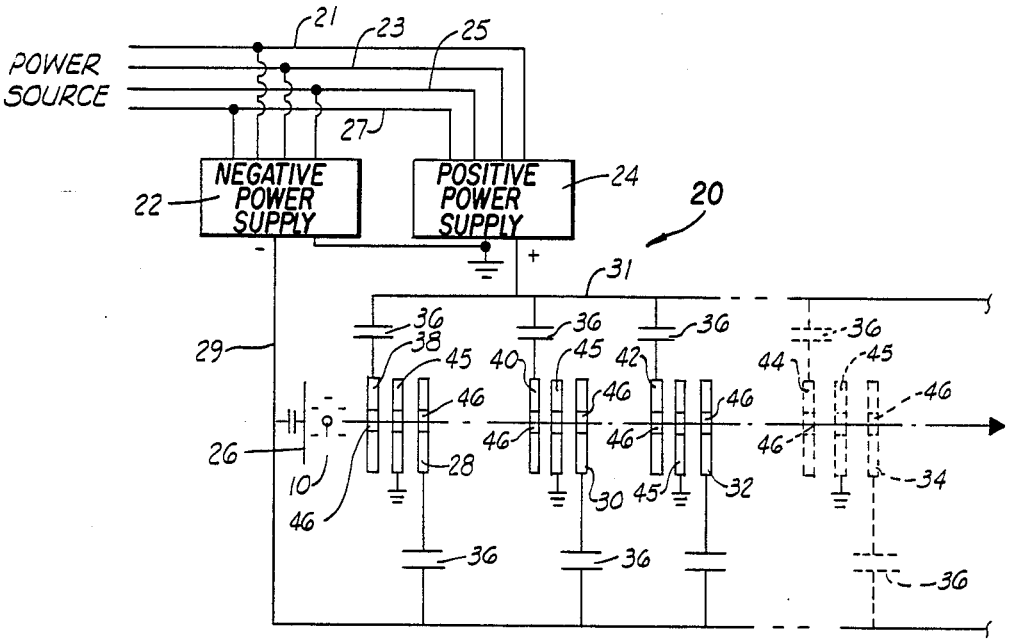
FIG. 2 shows a schematic of the energy weapon.

In FIG. 2 the electrostatic kinetic energy weapon is shown and designated by general reference numeral 20. In this design high voltage power supplies 22 and 24 provide power received from a power source through leads 21, 23, 25 and 27. Negative power supply 22 is connected via lead 29 to negative plate 26 and negative accelerator plates 28, 30, 32 and 34 with the plates having capacitors 36. A positive power supply 24 is connected to positive accelerators plates 38, 40, 42 and 44 via lead 31 and having capacitors 36. As previously noted additional grounded plates 45 may be placed between plates 28 and 38, 30 and 40, etc. Capacitors 36 are not required under the conditions that the accelerator plates can be charged to a level whereby the charge located on the plates is not significantly reduced by the passage of the charged projectile 10. The negatively charged projectiles 10 with an opposite charge to the plate 38 is placed in the vicinity of this plate. The plate 38 attracts the projectile 10 to and through a hole 46 therein. The negative plate 26 is placed close to the plate 38. This positioning places a field between the two plates and a field between the plates 38 and 28. As the projectile 10 passes through holes 46 in the plates, energy is taken from the system 20 through the capacitors 36. At each stage, the velocity of the projectile 10 is increased. As the projectile 10 increases speed, the distance between negatively charged plates is increased. This is necessary because of the reduced time that the projectile 10 remains in the field. The plates 34 and 44 are shown in dotted lines and represent any number of spaced accelerator plates with holes 46 therein for receiving the projectile 10 therethrough.

The electrostatic forces are conservative and when the masses are very small, such as the case with subatomic particles, time is not a factor. In the present invention, however, the mass of the projectile 10 causes time to be a factor as required by Newton's laws of motion.

Figure 3A:
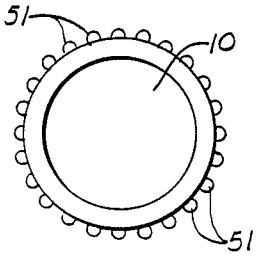

In FIG. 3 the projectile 10 can be made up of either a metal or a non-conductive shell 50. The preferred embodiment of the projectile is a thin hollow shell of maximum radius for the S.G. of the material. The hollow shell can be conductive or nonconductive or it may be non-conductive with a sputtered or otherwise fabricated thin conductive layer. If it is desired, the projectile 10 can be non-conductive and the charges on the plates would then be reversed. The projectile 10 is constructed so the radius is as large as possible and still retain structural rigidity. This rigidity can be obtained by filling the shell 50 with, for example, a pressurized gas, a vacuum or a low mass filler. In the alternative, as shown in FIG. 4, the projectile 10 could look like a sharp pointed pin cushion or sea urchin having outwardly extending pointed pins 52. The pointed pins 52 would permit a higher charge density than the projectile 10 as shown in FIG. 3. Also, the pins 52 would provide improved penetration into a target. FIG. 3A shows the projectile 10 with a knobby surface 51. This is another alternate construction of the projectile.

Figure 5:
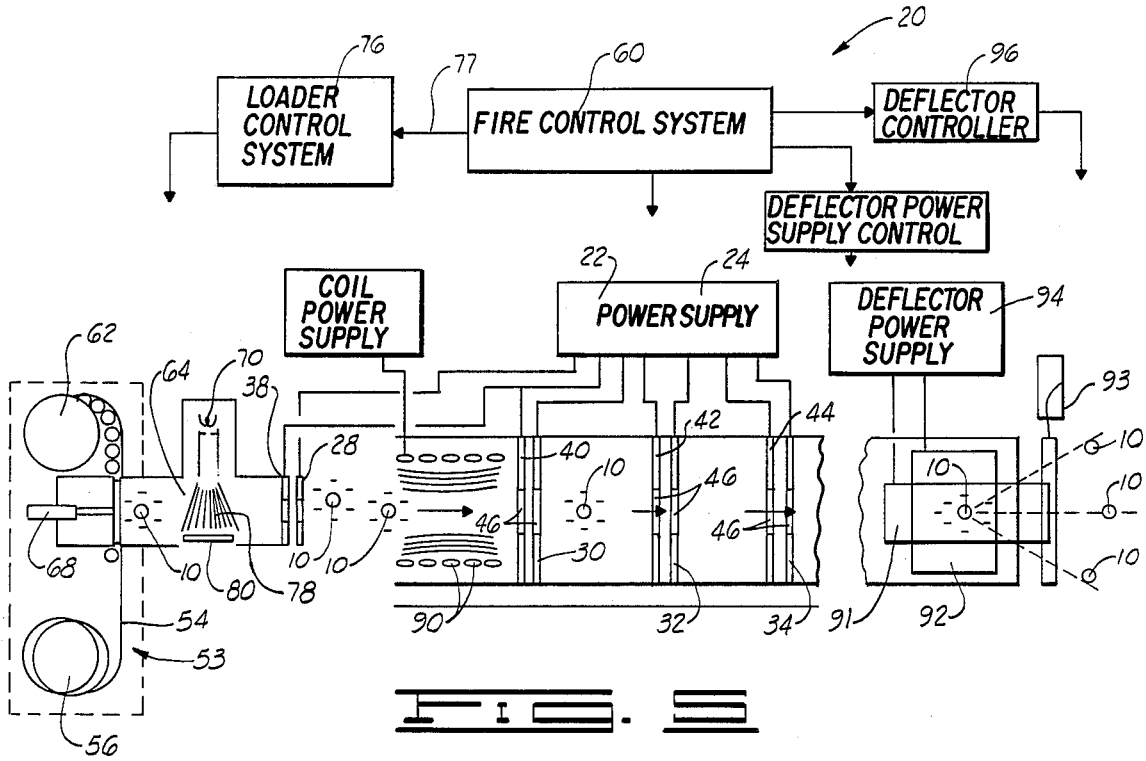
FIG. 5 shows all of the major elements of the energy weapon.
Figure 6:
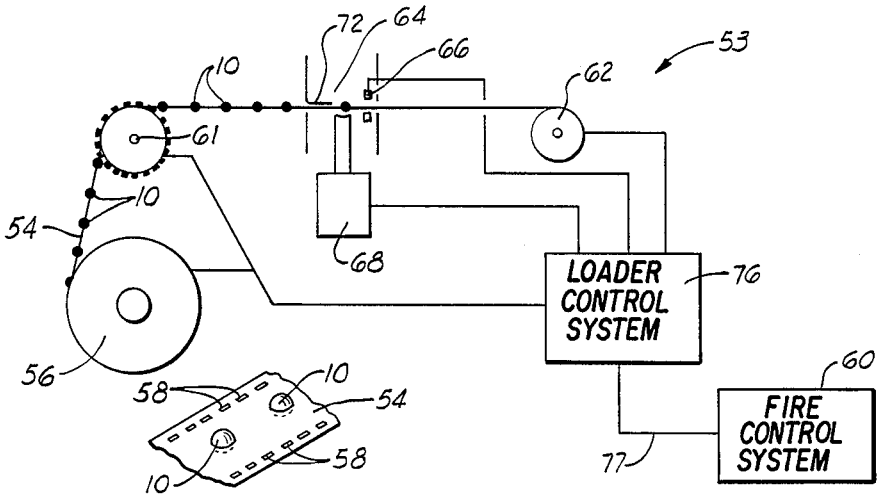
FIG. 6 illustrates the automatic loading mechanism of the energy weapon.

In FIG. 5 the electrostatic kinetic energy weapon 20 is shown having an automatic projectile feeder mechanism 53 provided to enable the system 20 to fire multiple projectiles 10 at high speeds. The details of the feeder mechanism is shown in FIG. 6. The projectiles 10 are placed on a tape 54 which is wound onto a storage magazine 56. The tape 54 has sprocket holes 58 along the sides thereof for use in accurate alignment. Upon command from a weapon's fire control system 60, a drive motor 61, which may be a digital stepping motor, and a power take-up reel 62 respond by moving a new projectile 10 to a loading chamber 64. A projectile sensor 66 recognizes that the projectile 10 is in place in the loading chamber 64. When the projectile 10 is in place, a projectile solenoid 68 is activated, giving the projectile 10 an initial impulse to move it up to the loading chamber 64 and in front of an electron beam charger 70. The beam charger 70 is shown in FIG. 5. The tape 54 is held in position by hold-down plate 72. The cycle is repeated as commanded by the weapon fire control system 60. All commands are executed by an automatic loader control system 76 connected to the weapon fire control system via lead 77.

Referring now to FIG. 5 as the projectile 10 moves out of the loading chamber 64, it passes through a fan shaped electron orion beam 78 provided by the electron orion beam charger 70. This charge is a broad beam electron beam gun of relatively standard design. The electron orion beam 78 is directed at the electron beam target 80 shown in FIG. 5. The projectile 10 continues and is attracted by plates 38 and 28. A magnetic field set up by coil 90 serves to center the projectile in the accelerator. Power for coil 90 is provided by power supply 91. In FIG. 5, the coil 90 may be replaced by an open cylindrical section as an alternate. An open gap between two parts of the cylinder provide an air gap that is bridged by a centering field. The projectile 10 is attracted by plate 40. The projectile passes through holes 46 and is repelled by plate 30. The process is repeated until it reaches deflector grids 91 and 92. Changes on the grid deflect the projectile 10. After passing thruogh the deflector plate 91 and 92, the projectile 10 passes through an ion bar 93 designed to neutralize the charge on the projectile 10. This neutralization of charges prevents the earth's field from changing the direction of the projectile 10 during flight. The grids 91 and 92 are connected to a deflector plate power supply 94 on command of a deflection plate controller 96 and a power supply controller 98.

Changes may be made in the construction and arrangement of the parts of elements of the embodiments as described herein without departing from the spirit or scope of the invention defined in the following claims.

What is claimed is:

1. An electrostatic kinetic energy weapon for accelerating a hollow macroscopic projectile along a predetermined path from an input end to an output end, said weapon comprising:

means for selectively feeding individual macroscopic projectiles to said input end;

means at said input end for charging the exterior surface of each said projectile with one polarity;

means for generating a plurality of bi-polar electrostatic fields in spaced relation along said path, said fields being polarly oriented to progressively accelerate each said projectile along said path toward said outlet end, the spacing between adjacent fields being progressively increased along said path toward said outlet end to provide a minimum residence time in each field as the velocity of said projectile increases;

means proximate the outlet end for selectively electrostatically diverting each said projectile from said path; and means at said outlet end for neutralizing the charge on the surface of each said projectile.

2. The weapon of claim 1 wherein said feeding means comprises means for storing a plurality of said macroscopic projectiles and means for selectively introducing into said input end one said projectile at a time from said storing means.

3. The weapon of claim 1 wherein said charging means comprises an ion beam generator disposed to contact the surface of each said projectile with an ion beam at said input end.

4. The weapon of claim 1 wherein said charging means comprises an electron beam generator disposed to contact the surface of each said projectile with an electron beam at said input end.

5. The weapon of claim 1 wherein said generating means comprises a plurality of pairs of members disposed in spaced relation along said path, each said member having an opening defining a passage for projectile travel along said path, and power means for charging the member of each of said pair on the input side thereof at the other polarity and for charging the member of each said pair on the output side thereof at the one polarity, when charged each said pair generating one said electrostatic field.

6. The weapon of claim 5 wherein said members are plates disposed transverse said path having holes generally coaxial with said path.

7. The weapon of claim 5 wherein said power means comprises an electrical power supply of one polarity connected to the output side members of each said pair and an electrical power supply of the other polarity connected to the input side members of each said pair.

8. The weapon of claim 1 wherein said diverting means comprises means proximate said output end for electrostatically imposing selective radial forces on each said projectile and diverting control means for selecting the direction and strength of said radial forces.

9. The weapon of claim 1 also including means downstream of said charging means for electromagnetically aligning each said projectile with said path.

10. A method of propelling individual hollow macroscopic projectiles at a target comprising the steps of:

feeding individual hollow macroscopic projectiles into one end of a charging chamber;

charging the exterior surface of each said projectile at a first polarity in said charging chamber;

generating a first bi-polar electrostatic field at another end of said charging chamber, said first field being disposed to electrostatically draw said projectile from said chamber and propel said projectile along a path away from said chamber;

generating an annular electromagnetic field to receive therethrough and center on said path each said projectile;

generating a plurality of spaced, second bi-polar electrostatic fields, each said field being disposed and oriented to progressively accelerate each said projectile along said path, the spacing between said fields along said path being progressively larger to ensure a minimum residence time in each field as the velocity of each projectile increases;

after each said projectile reaches a predetermined velocity, selectively imposing on each said projectile an electrostatically-generated radial force to divert each said projectile to a desired path; and neutralizing the charge on the surface of each said projectile after it has diverted to the desired path.

11. An electrostatic weapon comprising:

means for feeding a hollow sphere to one end of a defined path;

means at said one end for charging the exterior surface of said sphere at a first polarity;

electrostatic means for accelerating said sphere along said path to a desired velocity, said electrostatic means including a plurality of electrostatic field generating means disposed in spaced relation along said path for progressively attracting and repelling said sphere toward the other end of said path; and means for neutralizing the charge on the surface of said sphere after said desired velocity is achieved.

* * * * *